United States Patent [19]

Duistermaat et al.

[11] 4,111,694

[45] Sep. 5, 1978

[54] METHOD FOR MANUFACTURING THE PICTURE DISPLAY SCREEN OF A COLOR TELEVISION TUBE USING A CYLINDER LENS

[75] Inventors: Jan Hendrik Duistermaat; Johannes Cornelis Adrianus van Nes, both of Eindhoven, Netherlands

[73] Assignee: U.S. Philips Corporation, New York, N.Y.

[21] Appl. No.: 484,079

[22] Filed: Jun. 28, 1974

Related U.S. Application Data

[63] Continuation of Ser. No. 352,873, Apr. 20, 1973, abandoned.

[30] Foreign Application Priority Data

May 9, 1972 [NL] Netherlands ..... 7206241

[51] Int. Cl.[2] ..... G03C 5/00

[52] U.S. Cl. ..... 96/36.1; 96/27 E; 354/1

[58] Field of Search ..... 96/36.1, 27 E; 354/1; 313/92 SM

[56] References Cited

U.S. PATENT DOCUMENTS

| | | | |
|---|---|---|---|
| 3,003,874 | 10/1961 | Kaplan | 96/36.1 |
| 3,279,340 | 10/1966 | Ramberg et al. | 96/36.1 |
| 3,282,691 | 11/1966 | Morrell et al. | 96/36.1 |
| 3,429,704 | 2/1969 | Ratliff | 96/36.1 |
| 3,437,482 | 4/1969 | Yamada et al. | 96/36.1 |
| 3,582,326 | 6/1971 | Smithgall | 96/36.1 |
| 3,738,233 | 6/1973 | Schwartz | 95/1 R |

*Primary Examiner*—Edward C. Kimlin
*Attorney, Agent, or Firm*—Frank R. Trifari; Algy Tamoshunas

[57] ABSTRACT

An exposure device for establishing the phosphor dots of a shadow mask color television tube. The apertures in the shadow mask are optically projected from a light source onto a photosensitive layer on the window of the tube. Arranged between the light source and the shadow mask is a cylinder lens with its axis in the direction of one of the main directions of the deflection coil system.

1 Claim, 3 Drawing Figures

Figure 1:
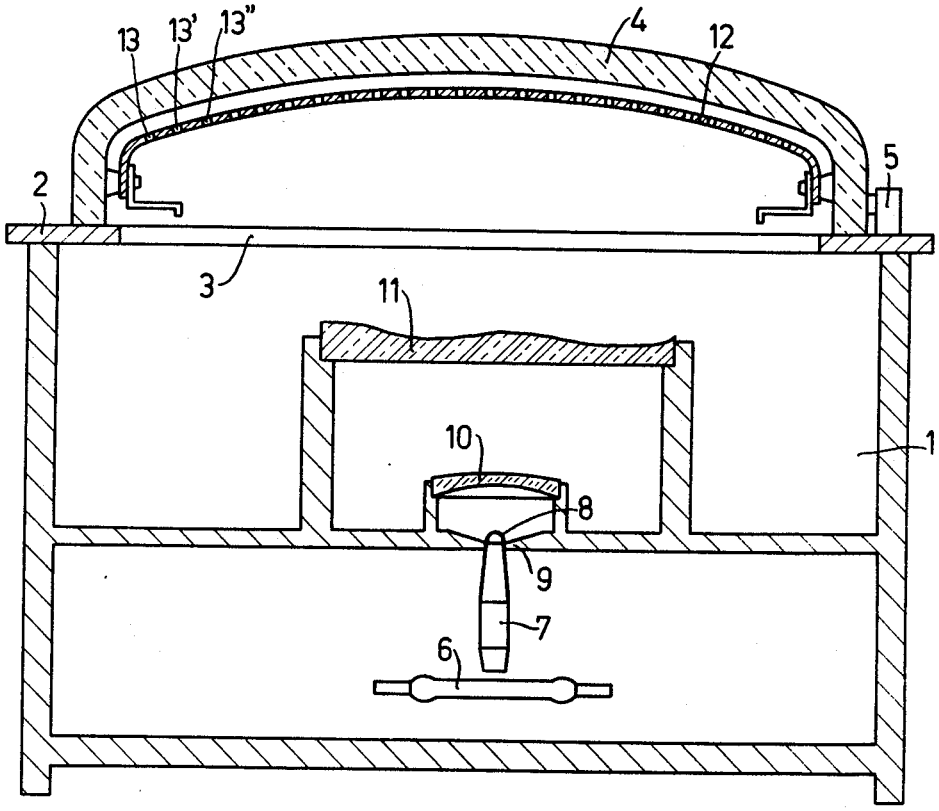
Figure 2A:
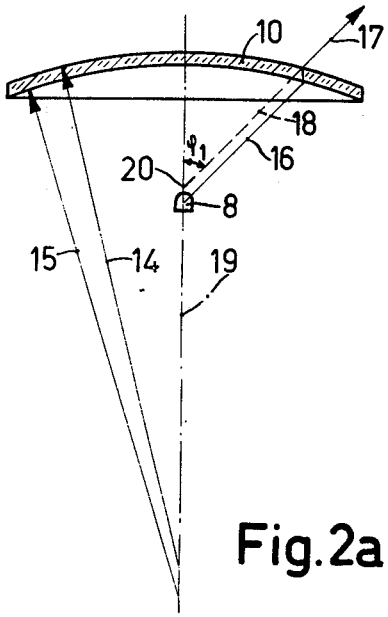
Figure 2B:
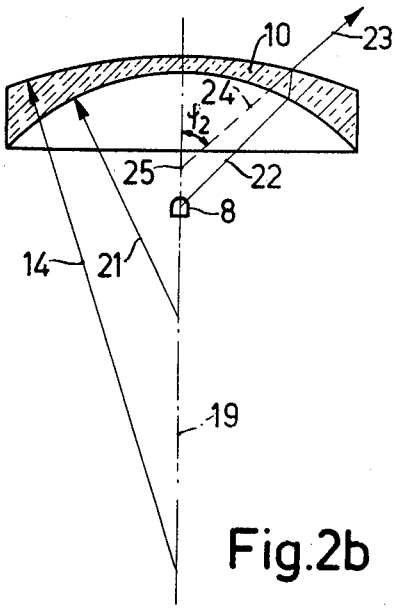

METHOD FOR MANUFACTURING THE PICTURE DISPLAY SCREEN OF A COLOR TELEVISION TUBE USING A CYLINDER LENS

This is a continuation, of application Ser. No. 352,873, filed Apr. 20, 1973, now abnd.

The invention relates to a method of manufacturing a colour television display tube comprising: optically projecting by means of a light source a pattern of systemically arranged apertures in a colour selection mask of the tube onto a radiation-sensitive layer on the window of the tube, in which said projection is mainly equal to the electron-optical projection of the same pattern on the display screen which is present on the window of the manufactured tube by an electron beam which scans the mask under the influence of a deflection coil system, the mask being placed in the same relative position relative to the radiation-sensitive layer as in the manufactured tube relative to the screen, the light source being arranged so that the light rays emitted by it pass through the apertures in the mask at substantially the same angle as the electron beam in the manufactured tube, a system of lenses being arranged between the light source and the mask and the intensity of which in the radial direction from its optical axis varies in such manner that the virtual image of the light source formed by the associated annular zone of the system of lenses experiences a substantially equal displacement parallel to the optical axis as the centre of deflection of the electron beam in a direction parallel to the axis of the tube in accordance with the instantaneous deflection angle of the electron beam. The invention also relates to a colour television display tube manufactured by such a method.

The screen of, for example, a three-colour television display tube is manufactured by means of such a method. Such a three-colour television display tube comprises an electron system which provides three electron beams the electrons of which move towards the screen via the apertures in the mask in tracks extending in different angular relationship relative to each other so as to produce the different colours. The location of the luminescent elements of the screen is established by using a photographic process in which the apertured mask serves as the negative and is provided in the same relative position relative to the radiation-sensitive layer as that which the mask will assume in the completed tube relative to the screen. The various radiation-sensitive layers are successively exposed each from a point which occupies the same relative position relative to the mask and the layer as that which the deflection centre of the various electron beams will assume in the finished tube relative to the mask and the screen. After each exposure the non-hardened parts of the radiation-sensitive layer are removed.

If under the influence of a deflection coil system the deflection angle of an electron beam increases, the centre of deflection of the electron beam moves closer towards the screen. However, the light which is used for establishing the location of the luminescent elements originates from a source which does not move, at least in that direction, so that the light rays will not pass through the apertures in the mask at the same angle as the deflecting electron beam afterwards in the display tube as a result of the displacement of the centre of deflection of the electron beam when same is deflected. In order to mitigate this, a system of lenses is arranged between the light source and the mask which system has a component the intensity of which varies in the radial direction from its optical axis and that in such manner that the virtual image of the light source which is formed by the associated annular zone of said component of the system of lenses experiences a substantially equal displacement parallel to the optical axis as the centre of deflection of the electron beam is displaced in a direction parallel to the axis of the tube in accordance with the instantaneous deflection angle of the electron beam. For the displacement in question of the virtual image of the light source, the system of lenses has a rotationally symmetric component, which means that a lens having a rotationally symmetric component or a separate rotationally symmetric lens is used.

Actually, the deflection coil system comprises two sets of deflection coils which produce the deflection in two mutually perpendicular directions, the main directions. The construction of the composition of the two sets of deflection coils generally results in the fact that the centres of deflection of the two sets of deflection coils do not coincide. When the deflection angle of an electron beam increases, each centre of deflection moves parallel to the axis of the tube and said centres of deflection generally do not remain coinciding. The result of this is that the target of the electron beam on the screen experiences a displacement which does not lie in the radial direction relative to the axis of the tube. In establishing the location of the luminescent elements, this cannot be mitigated by means of an above-described system of lenses which comprises only a rotationally symmetric component for the displacement of the virtual image of the light source in a direction parallel to the axis of the tube. In addition, the described system of lenses provides a correction which is in a certain manner correlated with the position of the centre of deflection relative to the axis of the tube, while the said difference in location of the centres of deflection in a direction parallel to the axis of the tube is in a certain manner correlated with the main direction of the deflection coil system. When the three electron beams are in a triangular arrangement, the position of each electron beam relative to the main directions of the deflection coil system is different. When the three electron beams in the non-deflected condition are located in one plane in which one of the main directions of the deflection coil system is also situated, the central electron beam coincides with the axis of the tube and the position of the two other electron beams relative to one of the main directions of the deflection coil system is different. The invention provides a certain measure which produces a displacement of the virtual image of the light source correlated with the main directions of the deflection coil system.

According to the invention, a cylinder lens is arranged between the light source and the mask and has its axis in the direction of one of the main directions of the deflection coil system. Such a lens produces a displacement of the virtual image of the light source which is different for the main directions of the deflection coil system.

The effect of such a lens associated with the system of lenses is illustrated with reference to the case in which the target of the electron beam on the screen in the case of increasing deflection experiences a displacement in a direction situated between the main directions of the deflection coil system, which displacement does not lie in the radial direction relative to the axis of the tube.

The displacement can then be resolved into a radial component and into a component in one of the main directions of the deflection coil system. The rotationally symmetric component of the system of lenses provides a displacement of the virtual image of the light source which results in a radial displacement of the luminescent elements corresponding to the radial component of the displacement which the target of the electron beam on the screen experiences when the deflection angle increases. In addition, the cylinder lens provides a displacement of the virtual image which results in a displacement of the luminescent elements in the direction of one of the main directions of the system of deflection coils corresponding to the component in that direction of the displacement which the target of the electron beam on the screen experiences when the deflection angle increases.

It is to be noted that in this case we have to do only with the change of place of the centres of deflection of the electron beams under the influence of the deflection coil system when the deflection angle increases parallel to the axis of the tube and with the lens elements to be incorporated in connection with said change during establishing the place of the luminescent elements. As is known, the centre of deflection of each electron beam in the case of the use of dynamic convergence moreover experiences a displacement which is dependent upon the deflection angle and which extends in the direction of the eccentricity of the beam relative to the axis of the tube. This should be mitigated by other properties of the system of lenses.

The invention will now be described in greater detail, by way of example, with reference to a drawing. In the drawing FIG. 1 is a diagrammatic sectional view of an exposure table for carrying out a method according to the invention.

FIGS. *2a* and *2b* are two mutually perpendicular sectional views of a part of the exposure table of FIG. 1.

Referring now to FIG. 1 which is a diagrammatic sectional view of an exposure table, reference numeral 1 denotes a substantially closed container. On its upper side it is closed by means of a lid 2 in which an aperture 3 is provided. On the lid 2 bears a window 4 on which the picture display screen of a colour television tube is provided. The place of the screen 4 on the lid 2 is determined by cams 5. The side of the window facing the aperture 3 is covered with a photosensitive layer of binder (not shown). Present in the container 1 is a light source which consists of a high pressure mercury vapour discharge lamp 6 and a slightly conical quartz body 7 having a rounded tip 8. The connection of the high pressure mercury vapour discharge lamp 6 and the quartz body 7 is not shown. The rounded tip 8 of the quartz body 7 projects through a circular aperture of the diaphragm 9. The light of the lamp 7 is guided in the quartz body 7 to the tip 8 from which the exposure takes place. The light of the tip 8 is radiated on the photosensitive layer of binder present on the window 4 by correction lenses 10 and 11 and via the aperture 3 through apertures 13, 13', 13'' etc. in a mask 12. Correction lens 10 is a cylinder lens which provides a displacement of the virtual image of the light source parallel to the tube axis which results in a displacement of the luminescent elements in the direction of one of the main directions of the deflection coil system. Correction lens 11 provides a rotationally symmetric displacement of the virtual image of the light source parallel to the tube axis and in addition a displacement of the virtual image of the light source in a direction at right angles to the tube axis.

In FIG. *2a* which shows diagrammatically a part of the sectional view of FIG. 1, reference numeral 8 denotes the tip of the cone and 10 is the cylinder lens. The radius of curvature of the convex surface of the lens 10 is denoted by 14 and that of the concave cylindrical surface is denoted by 15. A ray 16 originating from the conical tip 8 is refracted by the lens 10 and emanates as ray 17. The back elongation of the ray 17 is denoted by the broken line 18 which intersects the axis 19 in a point 20. The virtual image of the light source in the case of ray 17 which encloses an angle $\phi_1$ with the axis 19 lies in the point 20.

FIG. *2b* shows diagrammatically a sectional view of the conical tip 8 and the lens 10 at right angles to the cross-section of FIG. *2a*. The radius of curvature of the convex surface is denoted by 14 and that of the concave cylindrical surface is denoted by 21. A ray 22 of originating from the conical tip 8 is refracted by the lens 10 and emanates as ray 23. The back elongation of the ray 23 is denoted by the broken line 24 which intersects the axis 19 in a point 25. The virtual image of the light source in the case of ray 23 which encloses an angle $\phi_2$ with the axis 19 lies in the point 25.

Since the radius of curvature 15 of the concave spherical surface in FIG. *2a* is larger than the radius of curvature 21 of the concave surface in FIG. *2b*, point 20 in FIG. *2a* which is the place of the virtual image of the light source is more remote from the lens 10 than point 25 in FIG. *2b* which is the place of the virtual image of the light source.

In a given case, the thickness of the lens 10 at the area of the axis is 2.09 mm, the radius of curvature 14 of the convex surface is 193.9 mm and the radii of curvature 15 and 21 of the concave cylindrical surface are 191 and 80.7 mm, respectively.

What is claimed is:

1. A method of manufacturing a color television display tube comprising a window portion and an apertured selection mask, said tube being used in conjunction with a deflection coil system having deflection coils for deflecting an electron beam in plural main directions such that said beam scans said mask, comprising the steps of: (a) providing a radiation sensitive layer on said window portion, (b) placing said mask adjacent to the radiation sensitive layer, (c) providing a light source so that the light rays emitted by it pass through the apertures in the mask at substantially the same angle as the electron beam in the manufactured tube, (d) arranging a system of lenses between the light source and the mask, said lens system having a lens power value which varies in the radial direction from its optical axis such that the virtual image of the light source formed by the associated annular zone of the system of lenses is displaced in a direction parallel to the optical axis a distance substantially equal to the displacement of the center of deflection of the electron beam in a direction parallel to the axis of the tube in accordance with the instantaneous deflection angle of the electron beam, (e) arranging a cylinder lens between the light source and the mask to compensate for differences in the displacement of said center of deflection for a given angular deflection of the electron beam in different ones of said main directions due to differences in the characteristics of the deflection coils, and (f) optically projecting by means of said light source a pattern of systematically arranged apertures in said color selection mask onto said radiation sensitive layer.

* * * * *